US005689988A

United States Patent [19]

Schwarze

[11] Patent Number: 5,689,988

[45] Date of Patent: Nov. 25, 1997

[54] CNC-CONTROLLED PIPE BENDING MACHINE

[76] Inventor: Rigobert Schwarze, Olpener Strasse 460-474, 51109 Cologne, Germany

[21] Appl. No.: 688,107

[22] Filed: Jul. 29, 1996

[30] Foreign Application Priority Data

Aug. 22, 1995 [DE] Germany ..... 195 30 805.0

[51] Int. Cl.[6] ..... B21D 7/04; B21D 9/05

[52] U.S. Cl. ..... 72/157; 72/149

[58] Field of Search ..... 72/149, 157, 158, 72/159, 155, 156

[56] References Cited

U.S. PATENT DOCUMENTS

| | | | |
|---|---|---|---|
| 4,495,788 | 1/1985 | Traub | 72/157 |
| 4,567,745 | 2/1986 | Schwarze | 72/157 |
| 4,821,549 | 4/1989 | Schwarze | 72/157 |
| 4,888,971 | 12/1989 | Schwarze | 72/157 |
| 5,343,725 | 9/1994 | Sabine | 72/155 |
| 5,463,888 | 11/1995 | Nagai | 72/157 |

*Primary Examiner*—Lowell A. Larson
*Assistant Examiner*—Rodney Butler
*Attorney, Agent, or Firm*—Diller, Ramik & Wight, PC

[57] ABSTRACT

The pipe bending machine comprises a bending template (15) for bending the pipe therearound. The unbent pipe portion is supported on a pipe supporting rail (20) mounted on a pipe supporting rail carrier (25) and being adjustable in height. The height adjustment of the pipe supporting rail (20) is performed by a drive means (28), suited for stepless positioning, which sets the pipe supporting rail (20) to a height predetermined by the CNC control unit. Prior to the bending of the pipe, the height to which the pipe supporting rail (20) is to be moved is determined by the working program in dependance on a set of tool data which has been input into the control unit.

3 Claims, 3 Drawing Sheets

CNC-CONTROLLED PIPE BENDING MACHINE

The invention relates to a CNC-controlled pipe bending machine, and particularly to the drive means for height adjustment of the pipe supporting rail.

BACKGROUND OF THE INVENTION

A CNC-controlled pipe bending machine as known, e.g., from U.S. Pat. No. 4,495,788, comprises a bending template arranged to have the pipe pressed thereagainst by means of a clamping jaw. By turning the bending template simultaneously with the clamping jaw, the pipe is bent around the bending template. A pipe supporting rail supports the unbent pipe portion during the bending process. The pipe supporting rail is formed with a longitudinal groove adapted to the pipe and enclosing the pipe substantially around half the pipe diameter. The bending template can be designed as a multiple bending template having template portions of different bending radii arranged above each other. In such cases, also the clamping jaw is designed as a multiple clamping jaw, and for each of the bending planes arranged above each other, a dedicated pipe supporting rail or a dedicated portion of a multiple pipe supporting rail is provided. Alternatively, use can be made of a sole pipe supporting rail which, by means of a piston-cylinder unit, is adjusted in height along a connecting link guide on a pipe supporting rail carrier, to thus adjust the pipe supporting rail to the height of that bending groove of the bending template which is currently intended for use.

In known pipe bending machines, the adjusting of the pipe supporting rails requires a considerable effort. If the tool set has to be changed for a certain pipe bending task, the height of the pipe supporting rail must be readjusted, involving a bothersome working step. The height adjustment required in each respective case also depends on the constructional design of the machine.

It is an object of the invention to provide a CNC-controlled pipe bending machine which, especially when exchanging the bending tools, can be prepared and rendered operative in a simplified manner.

SUMMARY OF THE INVENTION

In the pipe bending machine according to the invention, a drive means designed for stepless positioning and controlled by a control unit, is provided for height adjustment for the pipe supporting rail. This makes it possible to perform a fine-adjustment of the height of the pipe supporting rail and to adjust the pipe supporting rail steplessly to each desired height. In the context of the instant description, the term "stepless" means that a fine-positioning process can be performed without restriction to any noticeable stepwise moving pattern in height direction. This provision does not exclude the option to provide the drive means e.g. with a stepping motor to perform movement by very small intervals, which, however, are not to be understood as steps in the above sense.

The height data for adjusting the pipe supporting rail are delivered by the control unit which controls or respectively regulates the whole working sequence performed by the pipe bending machine. Said control unit includes e.g. an input means (i.e. a keyboard) for manual input of the height value. However, also a set of tool data or an identification for the currently used pipe supporting rail can be input into the control unit. In this case, the height adjustment value required for the respective group of tools or for the respective pipe supporting rail are stored in the control unit. This stored value is output to the drive means in dependence on the set of tool data or the identification to carry out the height adjustment. For the height adjustment process, also the respective constructional design of the machine or the type of the pipe bending machine can be considered.

The invention allows for a considerable reduction of the time demand for preparing the pipe bending machine. In pipe bending machines with a plurality of bending planes, the positioning of the pipe supporting rail to the currently used bending plane is performed quickly and accurately.

An especially important advantage resides in the option to mount an additional clamping element to the pipe supporting rail carrier or the pipe supporting rail. This clamping element will always seize the pipe in the same manner. The use of such clamping elements has previously been confined to bending machines with only one bending plane. As to the decrease of the wall thickness, the ovality and the curve quality, the same bending quality that is obtained by bending machines with a sole bending plane can now also be reached by machines designed for a plurality of bending planes.

The respective bending plane to be attained by the pipe supporting rail is positionally defined by the set of tool data stored in the working memory of the control unit. Prior to the actual bending process, the working program determines to which respective bending plane of the bending tools the pipe supporting rail is to be moved.

A preferred embodiment of the invention will be explained in greater detail hereunder with reference to the drawings.

DETAILED DESCRIPTION OF A PREFERRED EMBODIMENT

Figure 1:
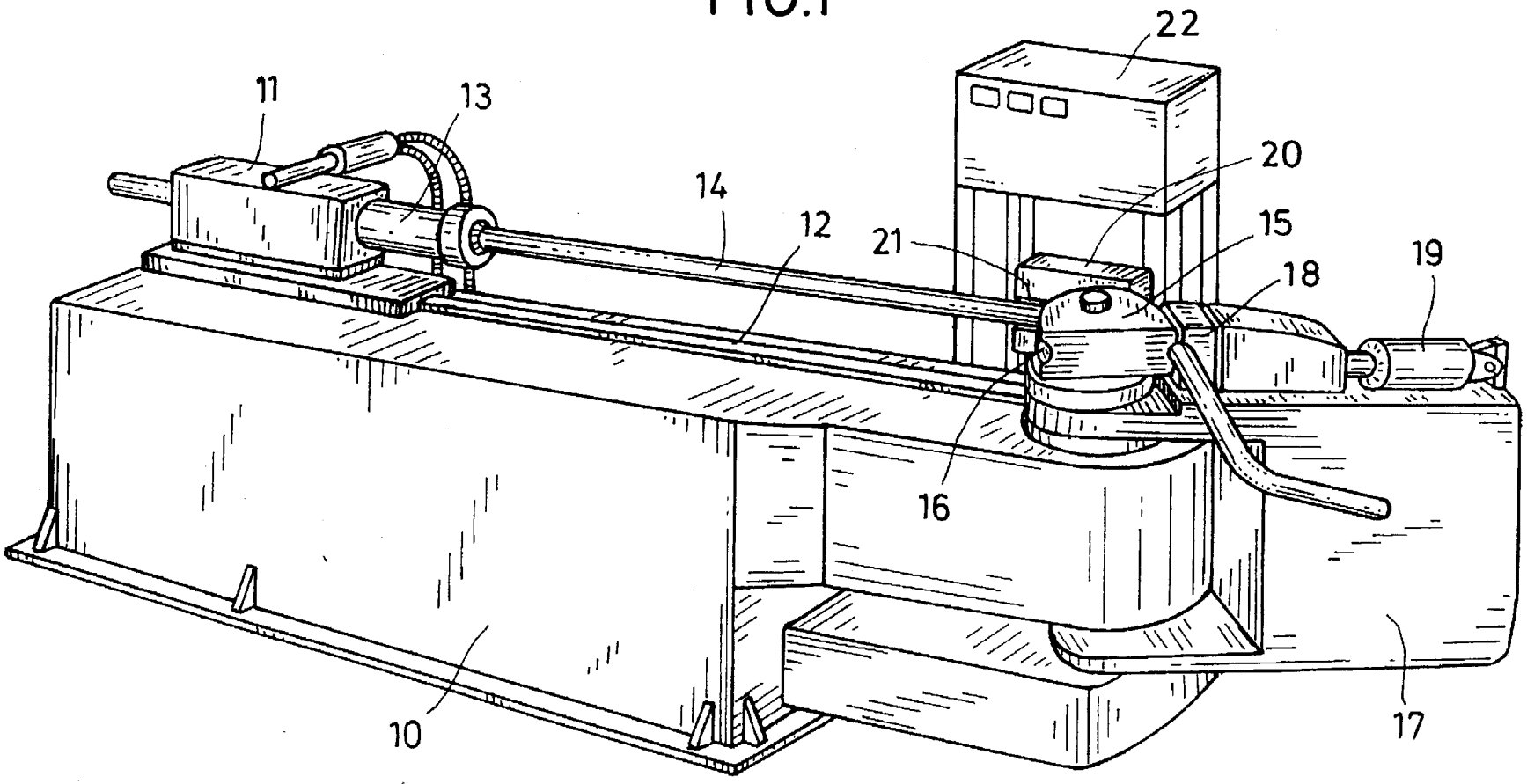
FIG. 1 shows a general perspective view of a pipe bending machine.

The instant pipe bending machine comprises a machine bench 10 whereon a transport carriage 11 can be horizontally moved in a longitudinal direction along a guide means 12. Transport carriage 11 carries a clamping means 13 for clamping the pipe 14 to be bent. In addition to its movement along said guide means 12, transport carriage 11 can be set to a horizontal position in the transverse direction of pipe 14 and be moved in height direction.

Pipe 14 is laterally set against the bending template 15 which can be turned about a vertical axis. Bending template 15 is provided on its periphery with a bending groove 16 formed to receive about half of the circumference of pipe 14. A pivot arm 17 is supported coaxially with bending template 15, carrying a clamping jaw 18 which, by a piston-cylinder unit 19, is pressed against bending template 15. Also clamping jaw 18 has a bending groove formed therein for receiving the other half of the circumference of pipe 14. In the bending process, clamping jaw 18 is first pressed against bending template 15, and then bending template 15 and pivot arm 17 are together turned or respectively pivoted about their axis, and the pipe is pulled around bending template 15 in the process.

To support the unbent pipe portion during the bending process, use is made of a pipe supporting rail 20 which also has a bending groove 21 formed therein. Pipe supporting rail 20 is moved together with pipe 14 while the pipe is pulled along during the bending process towards bending template 15.

All control processes of the pipe bending machine are numerically controlled and coordinated with each other through a control unit 22. This does not only apply to the moving sequence of the pipe bending process but also to the setting of the positions of transport carriage 11 and the bending tools, and to the turning and actuating of clamping sleeve 13.

Figure 2:
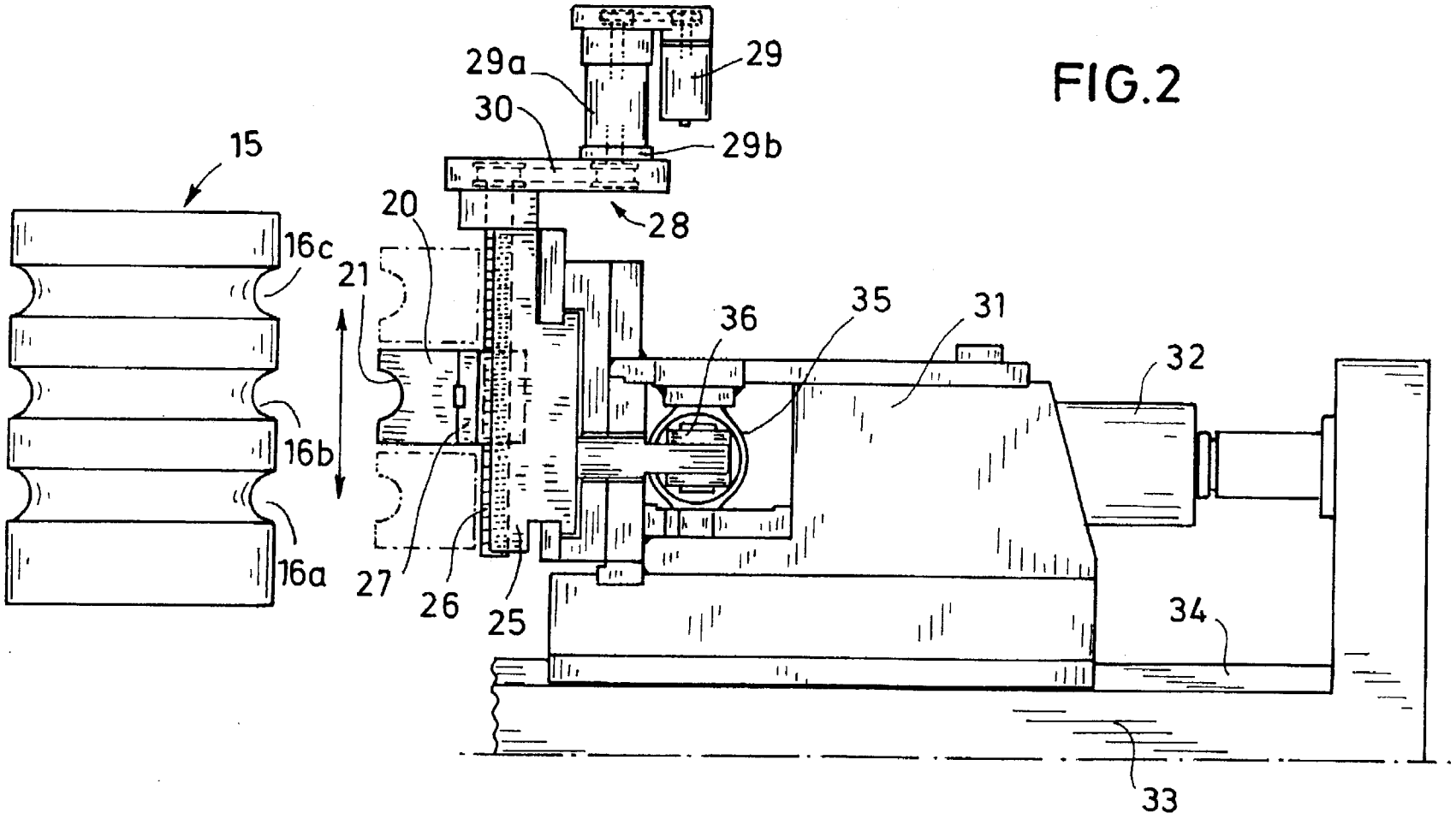
FIG. 2 shows a front view of the bending template and the device for holding the pipe supporting rail.
Figure 3:
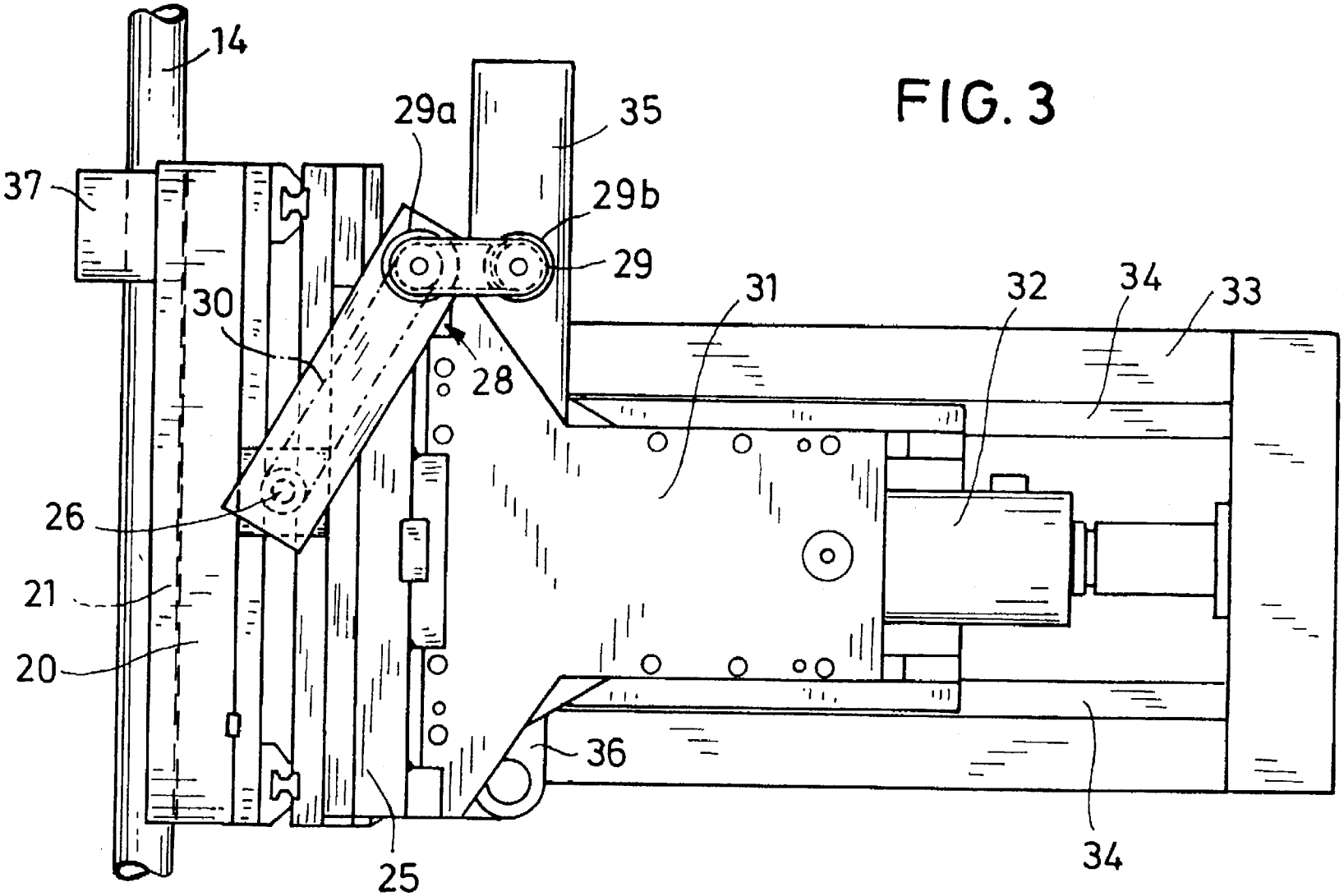
FIG. 3 shows a plan view of the arrangement illustrated in FIG. 2.

As illustrated in FIG. 2, bending template 15 comprises a plurality of bending grooves 16*a*,16*b*,16*c* arranged in different bending planes extending above each other. The diameters of the bending grooves correspond to the various diameters of the pipes to be treated. For pipes of a larger or smaller diameter, the bending template 15 will be exchanged.

Although a plurality of bending planes exist for the bending template 15, there is provided only one pipe supporting rail 20, adapted for linear movement in vertical direction along a pipe supporting rail carrier 25. Pipe supporting rail carrier 25 comprises a vertical spindle 26 engaging a spindle nut of a holder 27 having the pipe supporting rail 20 exchangeably mounted thereto. By turning said spindle 26, holder 27 is vertically moved together with pipe supporting rail 20. Spindle 26 is turned by a drive means 28. Drive means 28 comprises a hydraulic motor 29 having a CNC-controlled output shaft and driving the spindle 26 through a gear unit 29*a* and a synchronous belt drive 30. Synchronous belt drive 30 is arranged on the upper end of pipe supporting rail carrier 25 as a cantilever structure obliquely protruding in a lateral outward direction and having said hydraulic motor 29 along with gear unit 29*a* fastened to its free end.

The detection of the vertical position of pipe supporting rail 20 is performed by a sensor which is provided as a rotational angle encoder 29*b* emitting positional signals of holder 27 to control unit 22. Control unit 22 will then operate the hydraulic motor 29 to move the holder 27 exactly to the desired position on pipe supporting rail 20 which has been determined by control unit 22. Instead of providing such a feedback control, the drive motor can also be a stepped motor which is operated in a pulsed manner in small steps. In this case, the respective height of holder 27 can be derived from the number of the step pulses.

Pipe supporting rail carrier 25 is supported on a carriage 31 which, relative to the longitudinal direction of pipe supporting rail 20, is moveable laterally so as to press the pipe supporting rail against pipe 14. Carriage 31 is driven by a piston-cylinder unit 32 which is supported on a support means 33 fixedly connected to machine bench 10. Support means 33 comprises guide rails 34 for linear guidance of carriage 31.

Carriage 31 is further provided with a piston-cylinder unit 35 oriented in parallel to pipe supporting rail 20 and having its piston rod 36 engaging the pipe supporting rail carrier 25 for displacing the latter parallel to pipe 14. Piston-cylinder unit 35 acts as an advance drive operative to take along the pipe supporting rail 20 together with pipe 14 during the bending process or, additionally, to exert an advance force on pipe supporting rail 20.

Mounted on pipe supporting rail 20 is a clamping element 37 which, together with pipe supporting rail 20, will tightly enclose and clamp the pipe 14 so that the force generated by piston-cylinder unit 35 is transmitted, through the advance force, via pipe supporting rail 20 to the pipe 14, while pipe 14 is secured against displacement relative to pipe supporting rail 20.

Drive means 28 provides for a stepless positioning of pipe supporting rail 20 according to signals delivered by control unit 22. When exchanging the bending template 15, it may occur that the bending planes—i.e. the horizontal center planes of the bending grooves—of the new bending template have a height different from that of the previously used bending template. When the data of the currently used bending template are communicated to control unit 22, the control unit calculates the working height to which the pipe supporting rail 20 is to be moved, and will monitor the maintenance of this working height.

The present invention is also applicable if the bending template comprises only a sole bending groove. In such bending templates, the height of the bending plane may vary from one template to the next one. The control unit 22, when receiving information on the type of the respective bending template, automatically sets the height of the associated pipe supporting rail 20. Also this feature contributes to the reduction of the time demand for rendering the pipe bending machine operative.

I claim:

1. A CNC-controlled pipe bending machine comprising a bending template (15), means for rotating the bending template (15), clamping jaw means (18) for pressing the pipe (14) against the bending template (15), a pipe supporting rail (20) for engaging an unbent pipe portion of the pipe (14), means mounting said supporting rail (20) for height adjustment on a pipe supporting rail carrier (25), advance drive means (35) for displacing the pipe supporting rail (20) in the longitudinal direction during the bending process, control unit means (22) for controlling the bending process, drive means (28) for stepless height adjustment positioning of the pipe supporting rail (20), said drive means (28) being responsive to a height command signal delivered to said drive means (28) by the control unit means (22), and said height command signal corresponds at least to one of tool data and pipe supporting rail data input into said control unit means (22) whereby pipe supporting rail (20) adjustment is effected rapidly and automatically.

2. The pipe bending machine according to claim 1, wherein the drive means (28) for height adjustment of the pipe supporting rail (20) is a spindle drive (26) associated with a means (29) for continuous linear position measuring.

3. The pipe bending machine according to claim 1, wherein, in case of a plurality of bending planes of the bending template (15) and the clamping jaw (18), the pipe supporting rail (20) is provided with a clamping element (37) for clamping fixation of the pipe (14).

* * * * *